US005273324A

United States Patent [19]

Kobayashi

[11] Patent Number: 5,273,324

[45] Date of Patent: Dec. 28, 1993

[54] POWER DOOR LOCK DEVICE

[75] Inventor: Fumio Kobayashi, Yokohama, Japan

[73] Assignee: Ohi Seisakusho Co., Ltd., Yokohama, Japan

[21] Appl. No.: 31,845

[22] Filed: Mar. 16, 1993

[30] Foreign Application Priority Data

Mar. 31, 1992 [JP] Japan ..... 4-026588[U]

[51] Int. Cl.[5] ..... E05C 3/26

[52] U.S. Cl. ..... 292/201; 292/216

[58] Field of Search ..... 292/48, 196, 223, 280, 292/216, 201, 336.3

[56] References Cited

U.S. PATENT DOCUMENTS

| | | | |
|---|---|---|---|
| 3,655,240 | 4/1972 | DuRocher et al. | 292/201 |
| 3,751,088 | 8/1973 | Schlage et al. | 292/201 |
| 4,691,949 | 9/1987 | Granty et al. | 292/216 |
| 4,814,557 | 3/1989 | Kato | 292/216 X |
| 4,904,006 | 2/1990 | Hayakawa et al. | 292/216 X |

FOREIGN PATENT DOCUMENTS 62-28271 6/1987 Japan .

*Primary Examiner*—Richard E. Moore
*Attorney, Agent, or Firm*—Foley & Lardner

[57] ABSTRACT

A power door lock device comprises a latch plate pivotal about a first axis to assume an open position, a half-latch position and a full-latch position; a sub-lever pivotal about a second axis which is in parallel with the first axis; and a close lever pivotal about the second axis. The sub-lever has an engaged edge and is pivotally connected through a link to the latch plate, so that when the sub-lever is pivotal about the second axis to assume first, second and third angular positions, the latch plate takes the open position, half-latch and full-latch positions respectively. The close lever has an engaging edge which, when the close lever is pivoted from an inoperative position to an operative position, is brought into abutment with the engaged edge of the sub-lever to pivot the sub-lever from the second position to the third position. An electric drive device is used for forcing the close lever to pivot between the inoperative and operative positions. The latch plate, the link and the sub-plate are so arranged that the second angular position of said sub-lever is positioned near the first angular position of the same as close as possible.

8 Claims, 5 Drawing Sheets

POWER DOOR LOCK DEVICE

BACKGROUND OF THE INVENTION

1. Field of the Invention

The present invention relates in general to door lock devices for motor vehicles, and more particularly, to power door lock devices of a type which, when the door is closed to a half-latch position, forces the door move to a full-latch and full-closed position by electric power.

2. Description of the Prior Art

In order to clarify the task of the present invention, one conventional power door lock device of the above-mentioned type will be described, which is disclosed in, for example, Japanese Patent Second Provisional Publication 62-28271.

The door lock device of the publication comprises generally a lock proper which is mounted to a door and a striker which is secured to a vehicle body.

The door lock proper comprises a latch plate which is pivotal to assume an open position, a half-latch position and a full-latch position, a half-latch detecting switch which detects the half-latch position of the latch plate, a crank arm which is pivotally driven by an electric motor, and a close lever which is linked to the crank arm and linearly movable between inoperative and operative positions. The latch plate and the close lever are disposed on a common shaft to permit relative rotation therebetween. The open position of the latch plate is a position wherein the latch plate completely releases the striker, the half-latch position of the same is a position wherein the latch plate halfly or incompletely catches or latches the striker and the full-latch position of the same is a position wherein the latch plate completely catches or latches the striker. The inoperative position of the close lever is a position wherein the pivotal movement of the latch plate is not blocked by the close lever. When the close lever is moved from the inoperative position to the operative position, the close lever forces the latch plate to pivot from the half-latch position to the full-latch position. When the door is kept opened, the latch plate assumes the open position. When the door is pivoted to a position near a closed position, the latch plate receives the striker, and then when the door closing movement is further advanced with a certain but not strong force, the latch plate is turned by the striker from the open position to the half-latch position having the close lever left in the inoperative position. Upon this, the half-latch detecting switch detects the half-latch condition of the latch plate and energizes the electric motor to drive through the crank arm the close lever from the inoperative position to the operative position. With this, the latch plate is forced to turn from the half-latch position to the full-latch position moving the door from the incompletely closed position to a fully closed position.

However, due to its inherent construction, the above-mentioned power door lock device has the following drawback.

That is, in the door lock device, when, during the closing movement of the door, the latch plate is turned by the striker from the open position to the half-latch position, the close lever is left in the inoperative position. However, leaving the close lever at such inoperative position produces between the latch plate and the close lever a certain clearance of a size corresponding to the moved distance of the latch plate between the open position and the full-latch position. This means that before making an actual pivoting of the latch plate from the half-latch position to the full-latch position, the close lever is compelled to make a useless traveling by a distance corresponding to the certain clearance between the close lever and the latch plate. Thus, the action of the latch plate is delayed and thus quick movement of the door from the half-latch position to the full-latch full-closed position is not achieved.

SUMMARY OF THE INVENTION

It is therefore an object of the present invention to provide a power door lock device which is free of the above-mentioned drawback.

According to the present invention, there is provided a power door lock device which comprises a latch plate pivotal about a first axis to assume an open position, a half-latch position and a full-latch position; a sub-lever pivotal about a second axis which is in parallel with the first axis, the sub-lever having an engaged edge and linked to the latch plate, so that when the sub-lever is pivotal about the second axis to assume first, second and third angular positions, the latch plate takes the open position, half-latch and full-latch positions respectively; a close lever pivotal about the second axis, the close lever having an engaging edge which, when the close lever is pivoted from an inoperative position to an operative position, is brought into abutment with the engaged edge of the sub-lever to pivot the sub-lever from the second position to the third position; first means for forcing the close lever to pivot between the inoperative and operative positions; and second means for defining the second angular position of the sub-lever near the first angular position of the same as close as possible.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

In the following, a power door lock device of the present invention will be described in detail with reference to the accompanying drawings, Referring to FIG. 1 of the drawings, there is shown the power door lock device of the invention, which generally comprises a door lock proper (A) mounted to an automotive door and a door closure (B) also mounted to the door. The door lock proper (A) and the door closure (B) are connected through a wire 11. As will become apparent as the description proceeds, when, due to closing movement of the door, the door comes to a half-latch position wherein the door lock proper (A) assumes a half-latch condition, the door closure (B) forces the door to move from the half-latch position to a full-latch full-closed position by electric power.

Figure 2:
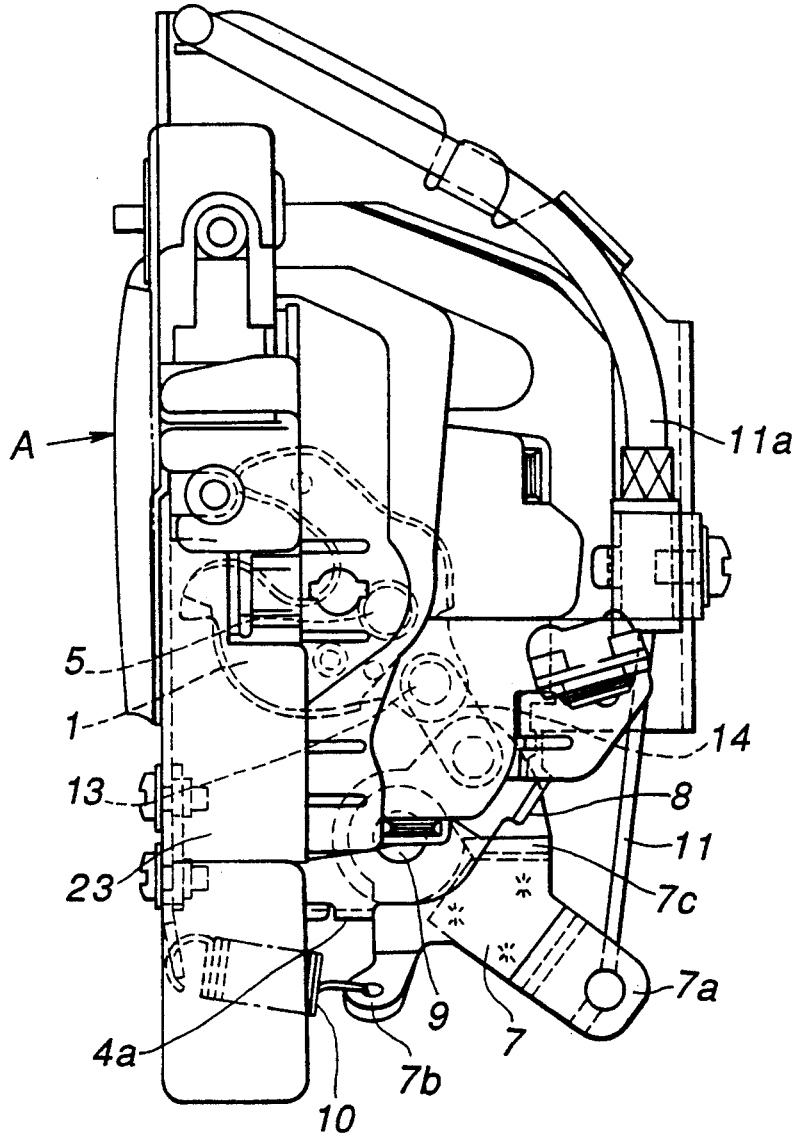
FIG. 2 is a front view of the door lock proper.
Figure 3:
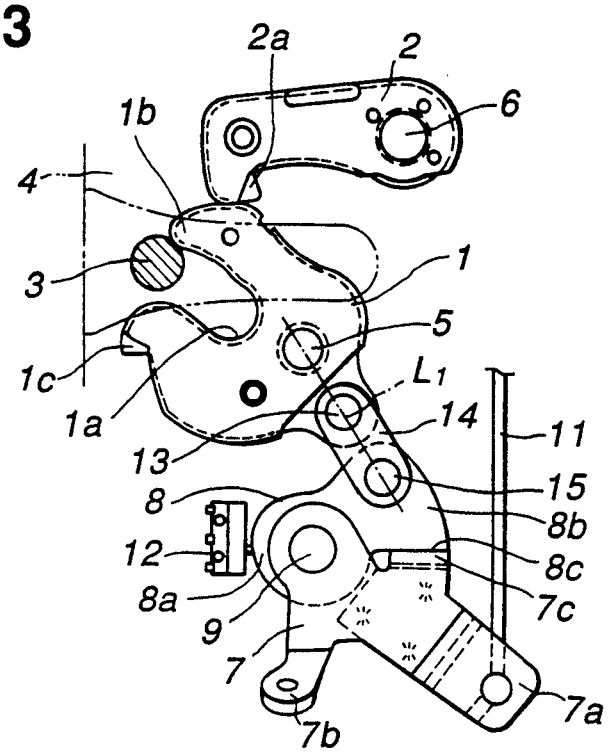
FIG. 3 is a view of several parts of the door lock proper, showing an open-condition of the power door lock device.

As will be understood from FIGS. 2 and 3, within a case of the door lock proper (A), there are installed a latch plate 1 which is engageable with a striker 3 secured to a vehicle body (not shown) and a locking plate 2 which is engageable with the latch plate 1. When the door is closed, the striker 3 on the vehicle body is inserted into the door lock proper (A) to achieve a latched connection between the door and the vehicle body with an aid of the door closure (B).

As is seen from FIGS. 2 and 3, the latch plate 1 is pivotally connected through a shaft 5 to a base plate 4 of the door lock proper (A). While, the locking plate 2 is pivotally connected to the base plate 4 through a shaft 6. The latch plate 1 can pivot to assume open, half-latch and full-latch positions.

As is seen from FIG. 3, when the latch plate 1 assumes the open position, the same has its recess la directed toward the striker 3 to permit insertion of the striker 3 thereinto. As is seen from FIG. 4, when the latch plate 1 assumes the half-latch position, the latch plate 1 halfly or incompletely catches or latches the striker 3 and the locking plate 2 has its pawl portion 2*a* engaged with a half-latch engaging portion 1*b* of the latch plate 1. As is seen from FIG. 6, when the latch plate 1 assumes the full-latch position, the striker 3 is fully latched by the latch plate 1 and the locking plate 2 has the pawl portion 2*a* latchedly engaged with a full-latch engaging portion 1*c* of the latch plate 1 blocking a turning of the latch plate 1 toward the open position. As will be understood hereinafter, when the full-latch position is taken, the door is fully closed and latched to the vehicle body.

Figure 5:
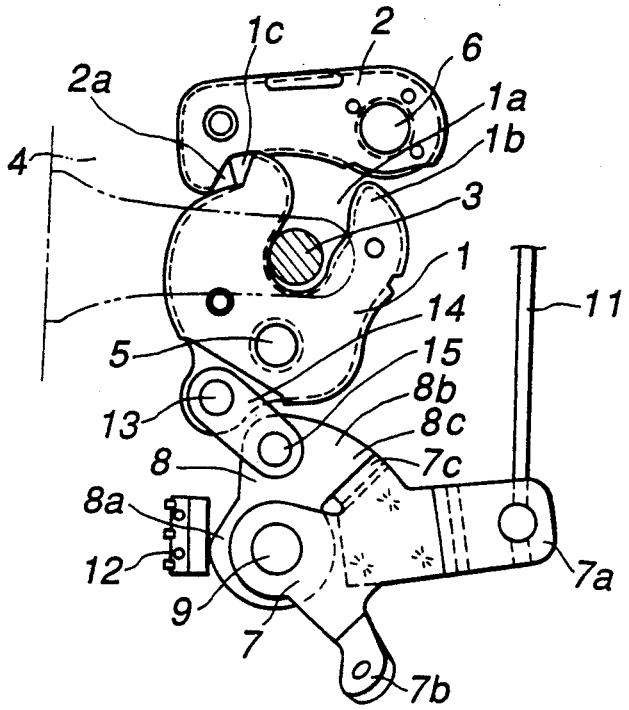
FIG. 5 is a view similar to FIG. 3, but showing a full-latch condition of the power lock device.

As is seen from FIGS. 2 and 3, a close lever 7 and a sub-lever 8 are rotatably disposed on a common shaft 9 which extends in parallel with the shaft 5 of the latch plate 1. The shaft 9 is secured to the base plate 4. The close lever 7 is formed with first and second arms 7*a* and 7*b*. The first arm 7*a* has at its base portion an engaging edge 7*c*. As is seen from FIG. 2, a spring 10 extends between the second arm 7*b* and the base plate 4, so that the close lever 7 is biased to pivot about the shaft 9 in a clockwise direction in the drawing. Usually, the close lever 7 assumes an inoperative position as shown in FIG. 3 wherein the second arm 7*b* abuts against a stopper 4*a* (see FIG. 2) defined by the base plate 4. As is seen from FIGS. 1, 2 and 3, the wire 11 extends from the first arm 7*a* to the door closure (B). As will be understood as the description proceeds, due to work of the door closure (B), the wire 11 is driven to pivot the close lever 7 in a counterclockwise direction from the inoperative position of FIG. 3 to an operative position as shown in FIG. 5.

As is seen from FIG. 3, the sub-lever 8 is formed with a cam portion 8*a* and an arm 8*b*. The arm 8*b* has at its one side an engaged edge 8*c* to which the engaging edge 7*c* of the close lever 7 is contactable. The arm 8*b* has a link 14 pivotally connected thereto through a pin 15. The link 14 is pivotally connected through another pin 13 to the latch plate 1. Thus, the sub-lever 8 is pivotally connected to the latch plate 1 through the link 14. That is, when the latch plate 1 assumes the open position as shown in FIG. 3, the sub-lever 8 assumes an inoperative position as illustrated in the drawing. When the close lever 7 is pivoted in the clockwise direction from the inoperative position to the operative position as shown in FIG. 5, the engaging edge 7*c* of the close lever 7 abuts against the engaged edge 8*c* of the sub-lever 8 to pivot the same in the same direction to an operative position as shown in FIG. 5.

As is seen from FIG. 3, when the latch plate 1 assumes the open position, the pin 13 is located on or in the vicinity of a straight line L1 which passes through the center of the other pin 15 and that of the shaft 5.

Figure 4:
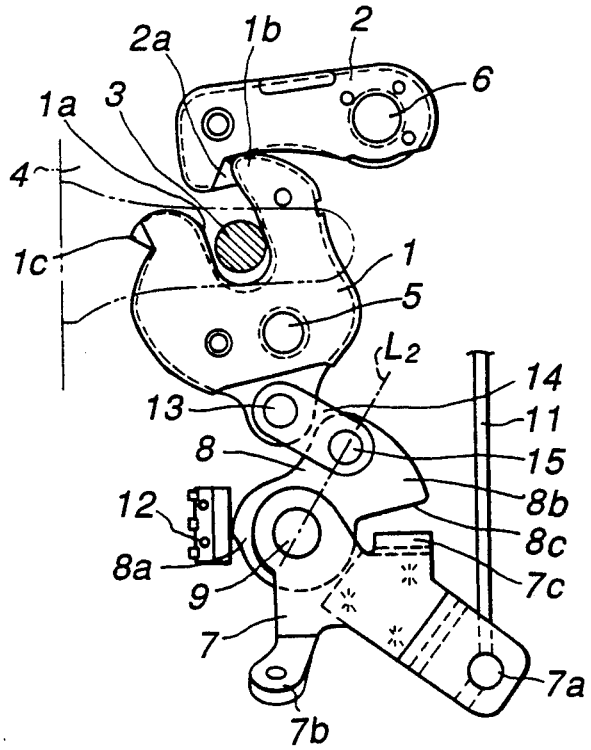
FIG. 4 is a view similar to FIG. 3, but showing a half-latch condition of the power lock device.

When the latch plate 1 is pivoted from the open position to the half-latch position as shown in FIG. 4, the pin 13 is moved from the above-mentioned position to a position as shown in FIG. 4. It is to be noted that the movement of the pin 13 is carried out in the vicinity of a dead point defined between the latch plate 1 and the link 14. Thus, even when the latch plate 1 is pivoted from the open position of FIG. 3 to the half-latch position of FIG. 4, the sub-lever 8 makes only a slight movement as is understood from FIG. 4. This means that upon such pivoting of the latch plate 1, there is produced only a slight clearance between the sub-lever 8 and the close lever 7, that is between the engaged edge 8*c* of the sub-lever 8 and the engaging edge 7*c* of the close lever 7.

As is seen from FIG. 4, when the latch plate 1 assumes the half-latch position, the longitudinal axis of the link is substantially perpendicular to a straight line L2 which passes through the center of the common shaft 9 and the pin 15. Thus, when, due to work of the door closure (B) conducted thereafter, the close lever 7 is pivoted in counterclockwise direction in FIG. 4, the pivoting of the close lever 7 is effectively or instantly transmitted to the latch plate 1 through the link 14. This is very important in the present invention.

Designated by numeral 12 is a latch plate position detecting switch which has a probe contacting with the cam portion 8*a* of the sub-lever 8. That is, by probing the shape of the cam portion 8*a*, the switch 12 can senses both the half-latch position and the full-latch position of the latch plate 1.

Figure 1:
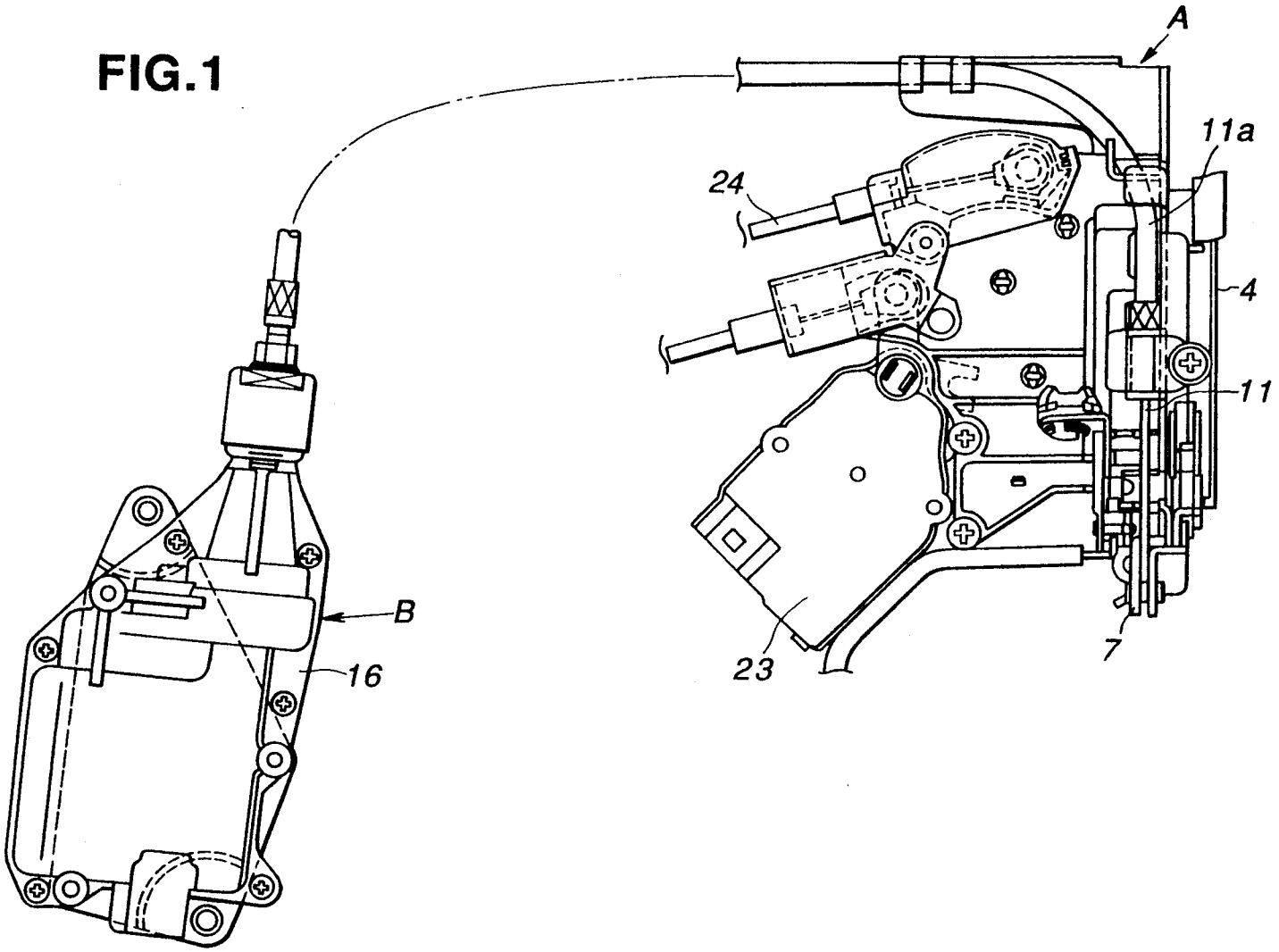
FIG. 1 is a side view of a power door lock device according to the present invention, which comprises a door lock proper and a door closure.

As is seen from FIGS. 1 and 2, a sleeve 11*a* of the wire 11 has one end fixed to a fixed part of the case of the door lock proper (A). The sleeve 11*a* has the other end fixed to a housing 16 of the door closure (B). The wire 11 and the sleeve 11*a* constitute a flexible cable.

Figure 7:
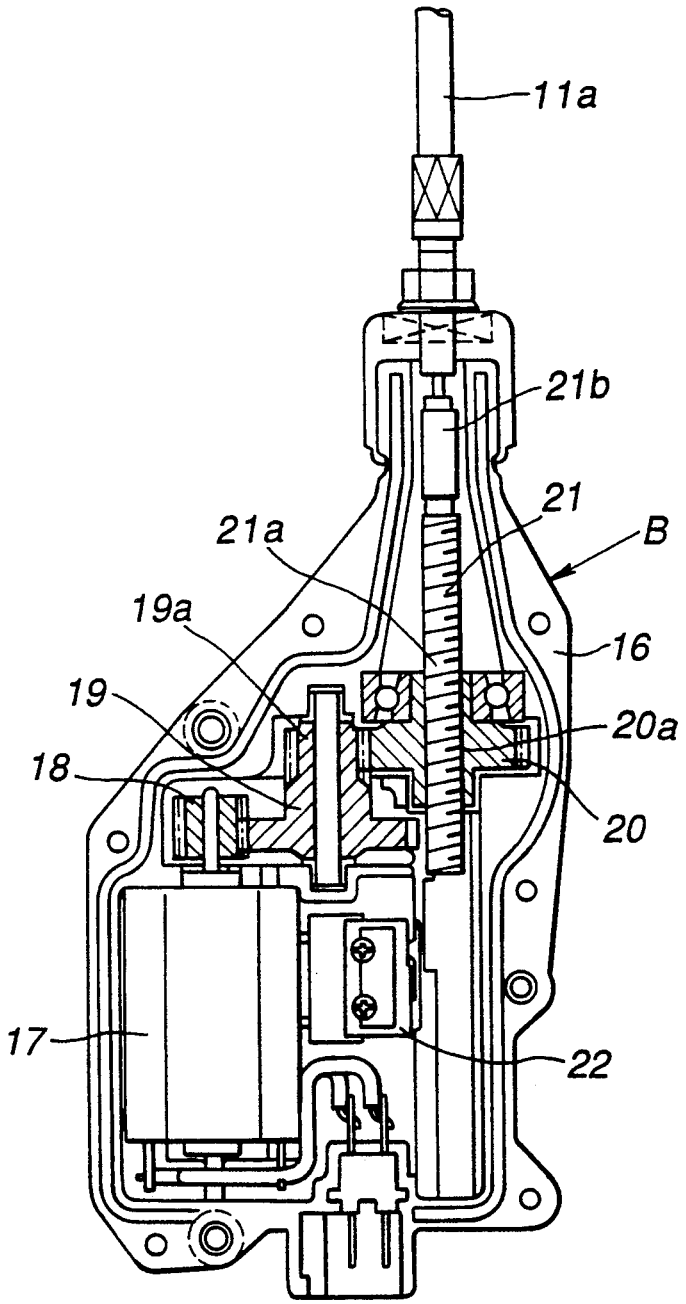
FIG. 7 is a partially sectional front view of the door closure.

As is seen from FIG. 7, the door closure (B) comprises the housing 16 and an electric motor 17. The electric motor 17 is connected to the latch plate position detecting switch 12. That is, in response to ON operation of the switch 12, the motor 17 is energized to run in normal or reversed direction. The motor 17 has a pinion 18 secured to an output shaft thereof. Meshed with the pinion 18 is a gear 19 which has a smaller diameter gear 19*a* integral thereto. Meshed with the smaller diameter gear 19*a* is a drive pinion 20 which has a threaded center bore 20*a*. A rod member 21 has a threaded part 21*a* inserted in and meshed with the threaded center bore of the drive pinion 20. Thus, when, due to work of the motor 17, the drive pinion 20 is rotated in one or the other direction, the rod member 21 is axially moved between an inoperative upper position as shown in the drawing and an operative lower position (not shown). Designated by numeral 22 is a rod member position detecting switch which can sense the inoperative position of the rod member 21.

The rod member 21 has an upper end 21*b* to which the wire 11 extending from the door lock proper (A) is fixed. That is, when the rod member 21 is moved from the inoperative position to the operative position, the wire 11 is pulled toward the door closure (B) thereby to pivot the close lever 7 from the operative position to the operative position.

Referring back to FIG. 1, designated by numeral 23 is a known electric actuator which can drive a locking-/unlocking lever (not shown) between locking and unlocking positions by electric power, the lever being installed in the door lock proper (A). The detail of such actuator is described in U.S. patent application Ser. No. 07/854,410 filed by the same applicant on Mar. 19, 1992. Designated by numeral 24 is a wire which extends between a door latch canceling means (not shown) mounted on an inboard side of the door and an inside lever (not shown) pivotally installed in the door lock proper (A). That is, when the door latch canceling means is manipulated, the wire 24 is driven to pivot the inside lever thereby to cancel a latched engagement between the locking plate 2 and the latch plate 1. Thus, the latch plate 1 is permitted to pivot toward the open position and thus the door becomes ready for opening.

In the following, operation of the power door lock device of the invention will be described with reference to the drawings, particularly FIGS. 3 to 6.

For ease of understanding, the description will be commenced with respect to a condition wherein the door is fully opened. Under this door open condition, the latch plate 1, the locking plate 2, the close lever 7, the sub-lever 8 assume their positions as shown in FIG. 3. That is, the latch plate 1 assumes the open position, and the close lever 7 and the sub-lever 8 assume their inoperative positions.

When, due to closing movement of the door, the striker 3 is inserted into the recess 1*a* of the latch plate 1, the latch plate 1 is pivoted from the open position of FIG. 3 to the half-latch position of FIG. 4 in a manner as has been described hereinabove. Upon this, the pawl portion 2*a* of the locking plate 2 is brought into latching engagement with the half-latch engaging portion 1*b* of the latch plate 1. In response to the pivoting movement of the latch plate 1 from the open position to the half-latch position, the sub-lever 8 is slightly pivoted to the position as shown in FIG. 4 wherein the engaged edge 8*c* of the sub-lever 8 is slightly spaced from the engaging edge 7*c* of the close lever 7.

When, due to the pivoting of the latch plate 1 to the half-latch position, the sub-lever 8 comes to the slightly moved position of FIG. 4, the latch plate position detecting switch 12 is turned ON and thus senses the half-latch position of the latch plate 1. Upon this, the motor 17 (see FIG. 7) of the door closure (B) is energized to run in normal direction thereby pulling the wire 11 toward the door closure (B). Thus, as is seen from FIGS. 4 and 5, the close lever 7 is pivoted from the inoperative position as shown in FIG. 4 to the operative position as shown in FIG. 5. During the pivoting, the close lever 7, more specifically, the engaging edge 7*c* of the close lever 7 is brought into abutment with the engaged edge 8*c* of the sub-lever 8 thereby to pivot the sub-lever 8 from the slightly moved position to an operative position as shown in FIG. 5.

It is now to be noted that because, in the half-latch condition of the latch plate 1, the clearance between the engaging edge 7*c* of the close lever 7 and the engaged edge 8*c* of the sub-lever 8 is very small, the pivoting movement of the close lever 7 toward the operative position of FIG. 5 instantly or quickly brings about the actual pivoting movement of the sub-lever 8 toward the operative position. In other words, the useless traveling of the close lever is very small in the present invention.

Figure 6:
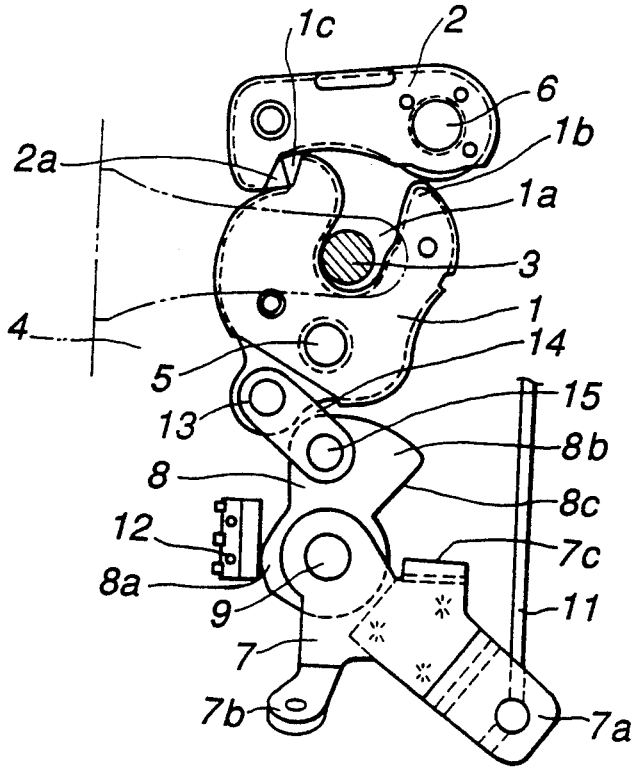
FIG. 6 is a view similar to FIG. 3, but showing a condition wherein operation for achieving a full-latch and full-closed condition of an associated door is finished.

Due to the pivoting movement of the sub-lever 8 toward the operative position as shown in FIG. 5, the link 14 brings the latch plate 1 to the full-latch position as shown in the drawing. Upon this, the pawl portion 2*a* of the locking plate 2 is brought into latching engagement with the full-latch engaging portion 1*c* of the latch plate 1, so that the full-latch position of the latch plate 1 is tightly held causing the full-latch and full-closed condition of the door. When the latch plate position detecting switch 12 detects the full-latch position of the latch plate 1, the motor 17 (see FIG. 7) of the door closure (B) is energized to run in reversed direction thereby pushing the wire 11 toward the door lock proper (A). With this, with an aid of the spring 10, the close lever 7 is returned to the inoperative position as shown in FIG. 6. With this, the operation for achieving the full-latch and full-closed condition of the door is completed.

When, under the full-latch condition as shown in FIG. 6, the door latch canceling means (not shown) is manipulated for the purpose of opening the door, the pawl portion 2*a* of the locking plate 2 is disengaged from the full-latch engaging portion 1*c* of the latch plate 1. With this, the latch plate 1 is permitted to pivot from the full-latch position of FIG. 6 to the open position of FIG. 3 by the force of a weather strip mounted to the door, so that the door is permitted to open. In response the return movement of the latch plate 1, the sub-lever 8 is returned to the inoperative position together with the link 14 as shown in FIG. 3.

As will be understood from the foregoing description, in the present invention, due to the unique arrangement between the latch plate 1, the sub-lever 8 and the close lever 7, the powered pivoting movement of the close lever 7 is quickly transmitted to the sub-lever 8 for achieving the movement of the latch plate 1 from the half-latch position to the full-latch position. That is, in the present invention, the useless traveling of the close lever 7 is minimized.

What is claimed is:

1. A power door lock device comprising:

a latch plate pivotal about a first axis to assume an open position, a half-latch position and a full-latch position;

a sub-lever pivotal about a second axis which is in parallel with said first axis, said sub-lever having an engaged edge and linked to said latch plate, so that when said sub-lever is pivotal about said second axis to assume first, second and third angular positions, said latch plate takes said open position, half-latch and full-latch positions respectively;

a close lever pivotal about said second axis, said close lever having an engaging edge which, when said close lever is pivoted from an inoperative position to an operative position, is brought into abutment with said engaged edge of said sub-lever to pivot said sub-lever from 20, said second position to said third position;

first means for forcing said close lever to pivot between said inoperative and operative positions; and second means for defining said second angular position of said sub-lever near said first angular position of the same as close as possible.

2. A power door lock device as claimed in claim 1, in which said second means comprises:

a link having one end pivotally connected to said latch plate through a first pin and the other end pivotally connected to said sub-lever through a second pin.

3. A power door lock device as claimed in claim 2, in which said latch plate, said link and said sub-lever are so arranged that when said sub-lever assumes said first angular position, said first pin is located at least in the vicinity of a straight line which passes through said first axis and the axis of said second pin.

4. A power door lock device as claimed in claim 3, in which said latch plate, said link and said sub-lever are so arranged that when said sub-lever assumes said second angular position, a straight line passing through the axes of said first and second pins is substantially perpendicular to another straight line which passes through the axis of said second pin and said second axis.

5. A power door lock device as claimed in claim 3, in which when said sub-lever and said close lever assume said first angular position and said inoperative position respectively, said engaged and engaging edges are in contact with each other.

6. A power door lock device as claimed in claim 1, in which said first means comprises:

a wire extending from said close lever; and an electric power means having an output device to which said wire is connected.

7. A power door lock device as claimed in claim 6, further comprising a latch plate position detecting switch which, upon detecting the half-latch position of the latch plate, energizes said electric power means to move, through said wire, said close lever from said inoperative position to said operative position.

8. A power door lock device as claimed in claim 1, further comprising a locking plate which is engageable with said latch plate to assure the half-latch and full-latch positions of said latch plate.

* * * * *